US007837187B2

(12) United States Patent
Stauber

(10) Patent No.: US 7,837,187 B2
(45) Date of Patent: Nov. 23, 2010

(54) DEVICE FOR SEPARATING INDIVIDUAL FLAT OBJECTS FROM A STACK AND FOR TRANSPORTING AWAY THE SEPARATED OBJECTS

(75) Inventor: Hans-Ulrich Stauber, Grut (CH)

(73) Assignee: Ferag AG, Hinwil (CH)

( * ) Notice: Subject to any disclaimer, the term of this patent is extended or adjusted under 35 U.S.C. 154(b) by 5 days.

(21) Appl. No.: 12/306,999

(22) PCT Filed: Dec. 13, 2006

(86) PCT No.: PCT/CH2006/000697

§ 371 (c)(1),
(2), (4) Date: Jan. 20, 2009

(87) PCT Pub. No.: WO2008/000099

PCT Pub. Date: Jan. 3, 2008

(65) Prior Publication Data

US 2009/0194930 A1 Aug. 6, 2009

(30) Foreign Application Priority Data

Jun. 30, 2006 (CH) ..... 1053/06

(51) Int. Cl.
*B65H 3/08* (2006.01)
*B65H 5/08* (2006.01)

(52) U.S. Cl. ..... 271/11; 271/99; 271/101

(58) Field of Classification Search ..... 271/11, 271/12, 99, 101
See application file for complete search history.

(56) References Cited

U.S. PATENT DOCUMENTS

| | | | | |
|---|---|---|---|---|
| 3,552,740 | A | 1/1971 | Hepp | |
| 6,554,268 | B1 * | 4/2003 | Keller et al. | 271/11 |
| 6,666,447 | B2 * | 12/2003 | Keller | 271/11 |
| 6,702,276 | B2 * | 3/2004 | Muller | 271/101 |
| 2002/0125629 | A1 * | 9/2002 | Keller | 271/11 |

FOREIGN PATENT DOCUMENTS

| | | |
|---|---|---|
| DE | 1137746 | 10/1962 |
| EP | 1226083 B1 | 8/2005 |

* cited by examiner

*Primary Examiner*—David H Bollinger
(74) *Attorney, Agent, or Firm*—Rankin, Hill & Clark LLP

(57) ABSTRACT

For separating individual flat and bendable objects (2) from the underside of a stack of such objects (2), and for the onward transportation of the objects, the invention provides a stacking space (1), a carrier wheel (3) on which suction devices (4) and grippers (5) are mounted, and transportation means (16), wherein the carrier wheel (3) is disposed below the stacking space (1) in such a manner that the suction devices (4), rotating with the carrier wheel (3), can consecutively take hold of an edge region of the object (2) at the bottom of the stack and bend it downward into the jaws of the following gripper (5), and in such a manner that the object (2) is then transported onward by the gripper (5) and can be deposited on the transportation means (6).

16 Claims, 4 Drawing Sheets

DEVICE FOR SEPARATING INDIVIDUAL FLAT OBJECTS FROM A STACK AND FOR TRANSPORTING AWAY THE SEPARATED OBJECTS

BACKGROUND OF THE INVENTION

1. Field of the Invention

The invention is located in the field of conveying flat, bendable objects, in particular printed products, and it concerns a device according to the generic term of the independent claim. The device serves for the separation of individual flat, bendable printed products from the underside of a stack of such objects and for the onward transportation of these objects, in particular for the separation of individual printed products from the underside of a stack of printed products and for onward transportation of the printed products.

2. Description of Related Art

From publication EP-1226083, a device is known which serves the purpose named above. For separation of individual printed products from the underside of the stack of printed products, the device includes a carrier wheel, arranged below the stack, rotating on a substantially horizontal axis, on the periphery of which pairs, each consisting of a suction device and a gripper allocated to the suction device, are arranged. The device further includes a supporting means, which on the one hand supports the stack from below, and on the other hand includes at least one extraction opening, through which the lowermost printed product may be gripped and for separation may be bent away from the stack towards the gripper allocated to the suction device.

The carrier wheel is arranged and driven such that the suction device and gripper are moved in parallel to a pair of edges of the stacked printed products and approximately centrally between these edges below the stack. The suction devices are rotated in a controlled manner during the rotation of the carrier wheel and connected to a suction pipe and de-coupled from it. The grippers are closed and re-opened in a controlled manner during the rotation. When a suction device is moved underneath the stack, it grips the lowermost printed product in the region of the edge orientated transversally to its direction of movement it meets first and when moving further it bends this edge region downwards through the extraction opening in the supporting means into the open gripper mouth of the allocated gripper, which then grips the printed product and removes it completely from the stack during its further movement.

In an embodiment described in publication EP-1226083, the supporting means on which the stack rests is a roll bed conveyor which includes a plurality of rollers arranged in parallel to each other, horizontally orientated and mounted to be freely rotatable, which rollers are aligned to the suction devices and grippers, however, are moved below the stack on a substantially rectilinear and horizontal path. Hereby the movements of the rollers and the suction devices are adjusted in relation to one another such that the suction device may grip the lowermost printed product of the stack between two successive rollers and may draw out its edge region, wherein the upstream roller of the two may move in-between the printed product gripped by the suction device and the printed product resting thereupon. The roll bed conveyor, thus, forms a succession of extraction openings orientated in parallel to the rollers and the printed product edges gripped by the suction devices, which openings successively move beneath the stack. In order for the stack to be securely supported and for the extraction openings to be large enough all the same, it is suggested to move the rollers beneath the stack in groups of three, wherein the rollers within the groups of three are at smaller distances from each other and wherein between succeeding groups a larger interspace is provided and only this interspace is used as extraction opening.

The rollers forming the roll bed conveyor underneath the stack consist of two mutually aligned roller sections, which are at a distance from each other. Thus, it is prevented that the suction devices conflict with the rollers. A circulating chain is provided on each side of the carrier wheel, one for the left roller sections and one for the right roller sections, wherein the roller sections are coupled to these chains and revolve with the chain at constant distances. The circulating path of the chains on both sides runs around a deflection roller arranged coaxially to the carrier wheel and around a further deflection roller with a parallel axis, which is arranged such that an upper part of the circulating paths is approximately horizontal between the deflection rollers. The stack is arranged above this region of the circulating path of the rollers.

The device according to EP-1226083, thus, includes a revolving roll bed conveyor with extraction openings, wherein the stack is arranged on the outside of this roll bed conveyor. For separation of the printed products from the stack the printed products are drawn through an extraction opening to the inner side of the circulating roll bed conveyor, from where they need to reach its outer side for being conveyed further. For this purpose the roller sections in the corresponding region are rotated into a substantially vertical position in their circulating path. In this region the printed products are laid down on a conveying belt and released by the grippers, wherein the conveying belt follows the circular movement of the grippers in a substantially tangential manner.

The device described in publication EP-1226083 works without problems and without requiring much space. It is, however, a costly device, which is restricted in connection with the direction of onward transportation.

The invention thus has the object of creating a device for the same purpose as the device described above according to EP-1226083, which is, however, relevantly more simple. Furthermore the device according to the invention is to be more flexible concerning the onward transportation, without requiring additional means.

BRIEF SUMMARY OF THE INVENTION

The device, according to the invention, thus serves for separation of individual flat, bendable objects from the underside of a stack of such objects and for the onward transportation of the objects. The device includes, similar to the device according to EP-1226083 a carrier wheel on which suction-device/gripper-pairs are mounted as well as a roll bed conveyor supporting the stack, the rollers of which move through beneath the stack and in-between which the lowermost flat object may be separated from the stack. Unlike the device according to EP-1226083 no individual circulation system is provided for the rollers forming the roll bed conveyor beneath the stack, but they are coupled to a roller wheel (or two roller wheels), which is arranged coaxially to and distanced from the carrier wheel. The roller wheel is driven at the same angular speed as the carrier wheel, advantageously via a mutual shaft.

The rollers are flexibly coupled to the roller wheel by means of levers, such that the levers are rotatable in parallel to the rotation plane of the roller wheel. A definite circulating path of the rollers and a definite and a permanently constant sequence of the rollers along this circulating path are defined by a roller guide, which defines the circulating path of the rollers, and advantageously by an additional controlling means.

The levers used for coupling the rollers to the roller wheel e.g. include two legs flexibly movable against each other in parallel to the rotation axis, wherein the additional controlling means defines a local pivot and/or joint position of the levers. The function of the additional controlling means is e.g. taken over by resilient means, by means of which the angle between the legs of the levers or between the inner leg and a tangent against the roller wheel is always held as small or as large as possible and/or through a joint guide, which defines the circulating path of the joints of the levers.

The levers used for coupling the rollers of the roller wheel may also have a variable effective length, wherein the additional controlling means define the pivot position and/or the effective length.

By means of a corresponding design of the roller guide, the levers and the additional controlling means, it is not only possible to realise circulating paths for the rollers which substantially deviate from the circular, but also to adjust different distances between the rollers in certain part regions of the circulating path than in others.

It shows that a revolving roll bed conveyor, as provided in the device according to the invention may be locally moved very flexibly, such that it may take on different functions in different locations of its circulating path. The roll bed conveyor of the device according to the invention may not only be moved substantially rectilinearly horizontally or slightly obliquely under the stack, but the distances between the rollers may also be successively reduced during the movement underneath the stack, such that the interspace is first sufficiently large for the passage of the suction device (extraction opening) and then becomes smaller for a good support of the stack. Furthermore, it is possible to let the roller circulate such that the upstream region of the objects gripped by the grippers always remain on the outer side of the roll bed conveyor and, thus, to dispose the objects on a means for onward transportation arranged on the outer side of the revolving roll bed conveyor. It is thus unnecessary to rotate the rollers in relation to their circulating path for the transfer to the device for onward transportation, as is necessary in the device according to the state of the art. Similarly, it is easily possible to design the rollers such that they do not conflict with the suction devices, such that the rollers may be of continuous design (without a gap in the middle for the suction device). Similarly, it is possible to design the circulating path of the rollers such that, the objects, while being disposed on the onward transportation means, press against it, such that it becomes possible without problems to give the onward transportation means a direction which is not adapted to the tangential movement of the gripper movement, but is e.g. directed in the opposing direction.

The device according to the invention may be designed as a feeder, in which the stack is maintained by personnel and which is e.g. displaceable (see in particular FIG. 2). The device according to the invention may, however, also be integrated into a larger installation, wherein the objects are fed to the stack by upstream installation parts, individually or in groups and wherein the stack e.g. serves as buffer.

Exemplified embodiments of the device according to the invention are described in detail in connection with the following figures. Hereby:

DETAILED DESCRIPTION OF THE INVENTION

Figure 1:
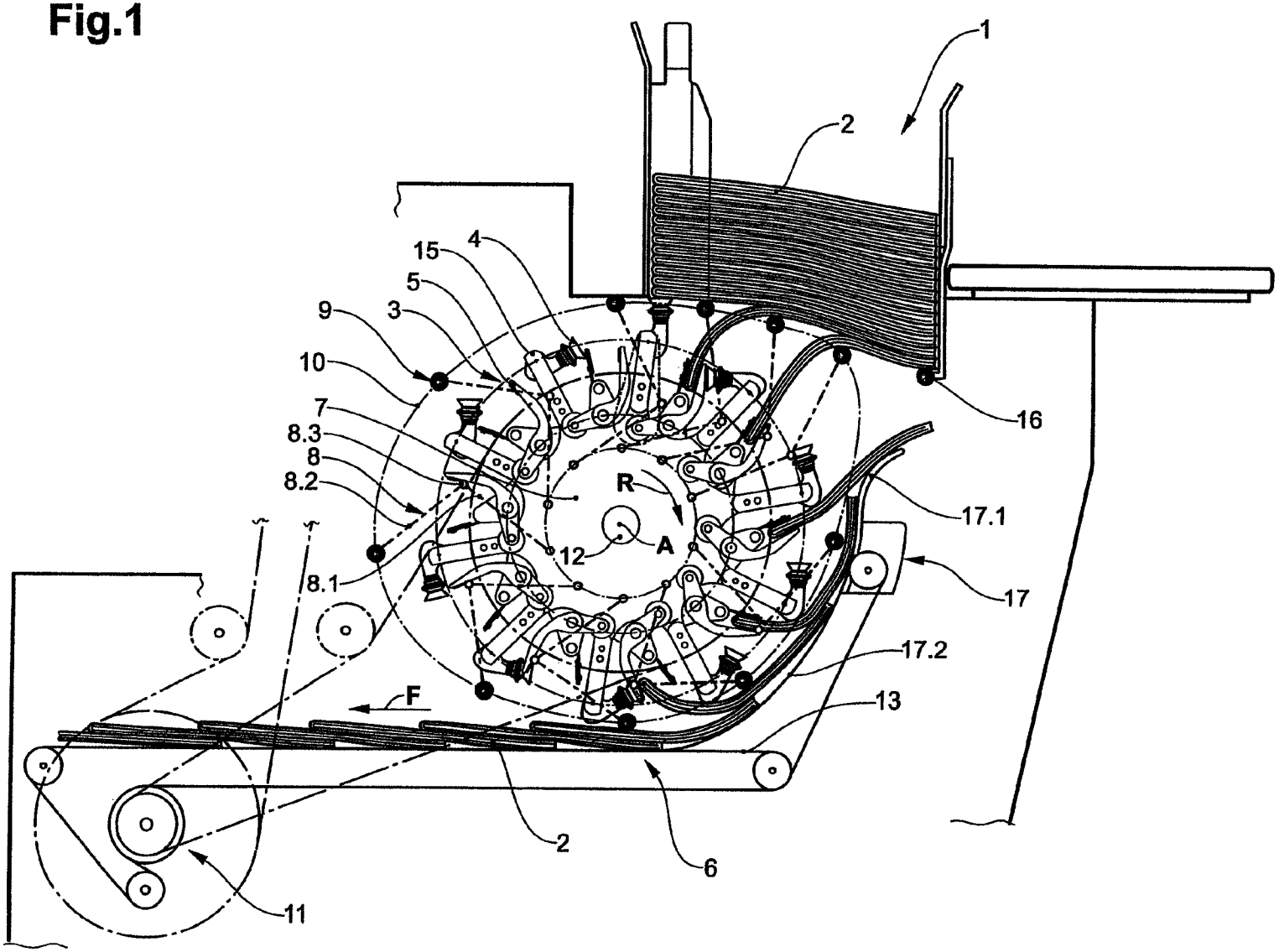
FIG. 1 shows a first exemplified embodiment of the device according to the invention for separation of individual flat, bendable objects from a stack of these objects and for onward transportation of the separated objects (angle of view in parallel to the axis of carrier and roller wheel)

FIG. 1 shows a first exemplified embodiment of the device according to the invention with an angle of view in parallel to the axis A of the carrier wheel and the roller wheel.

The device comprises a stacking space 1 in which flat objects 2, bendable at least in parallel to axis A, in particular printed products, are stacked on a roll bed conveyor, which is yet to be described. Beneath the stacking space 1, the rotating carrier wheel 3 is arranged with suction devices 4 and grippers 5 coupled to it, which are allocated to each other in pairs, such that the axis A is orientated substantially horizontally and in parallel to a pair of edges of the stacked objects 2 and that the suction devices 4 and grippers 5 are moved through approximately centrally underneath the stack. Beneath the carrier wheel 3, an onward transportation means 6 is arranged, which transports the object 2 onwards.

A roller wheel 7 is arranged coaxially to the carrier wheel 3 and axially distanced from it, to the periphery of which roller wheel levers 8 are coupled at regular angular distances. The levers 8 each comprise an inner leg 8.1 and an outer leg 8.2. The two legs 8.1 and 8.2 are flexibly connected to each other and thus pivotable in parallel to the rotation plane of the roller wheel (joint 8.3). The inner leg 8.1 is, in parallel to the rotation plane, pivotably connected to the periphery of the roller wheel 7. At the distal end of the outer leg 8.2, orientated perpendicular to the rotation plane of the roller wheel 7, the roller 9 is mounted in freely rotatable manner. The rollers 9 or the distal ends of the outer legs 8.2 are guided in a roller guide 10 (indicated with a broken line), wherein the roller guide 10 defines the circulating path of the rollers.

Figure 2:
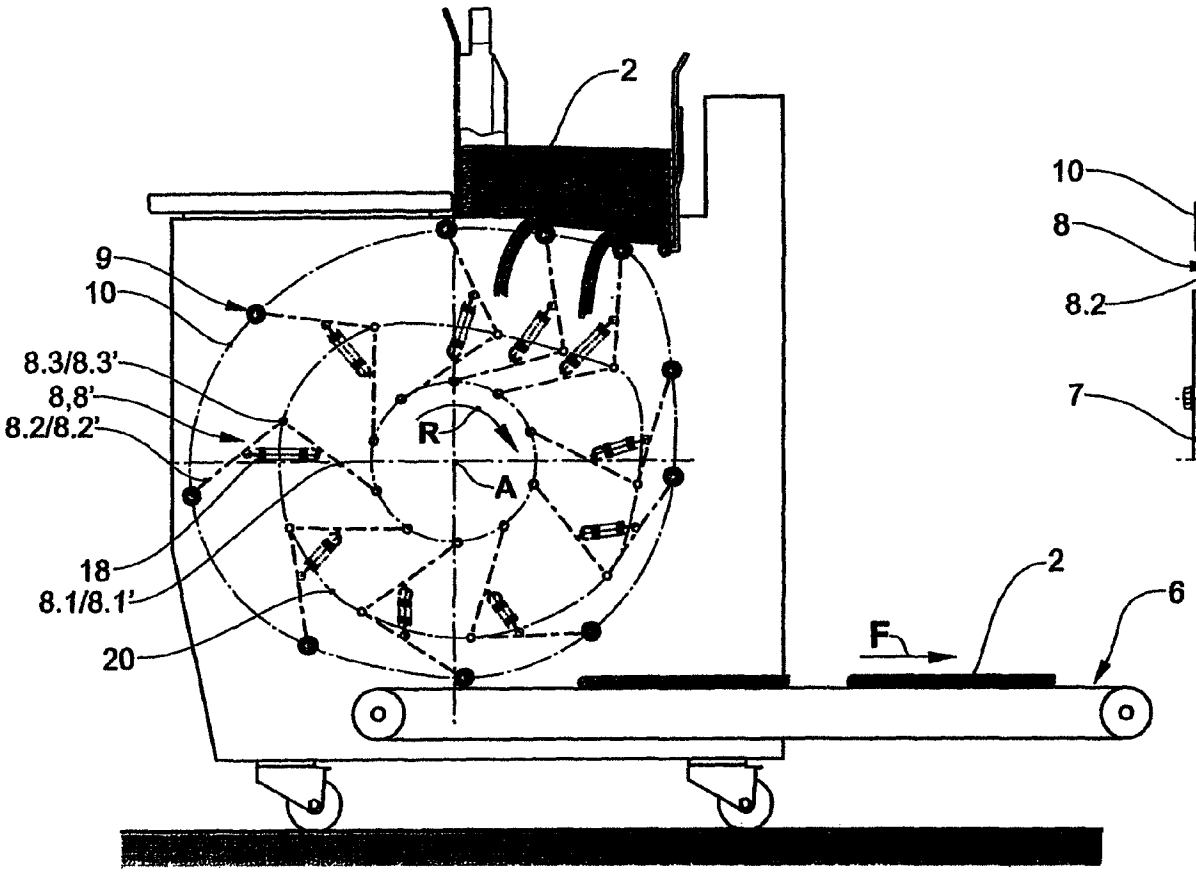
FIG. 2 shows a similar device as shown in FIG. 1, wherein the carrier wheel with the suction devices and grippers is not shown.

The arrangement of roller wheel 7, levers 8, rollers 9 and roller guide 10 is more evident from FIG. 2 than from FIG. 1.

The carrier wheel 3 and the roller wheel 7 are rotatingly driven at the same angular speed, in the present case clockwise (direction of rotation R). The suction devices 4 are rotated approximately in the 12 o'clock position onto the edge regions to be gripped of the stacked objects 2 and the objects are released approximately in the 6 o'clock position of the grippers.

The carrier wheel 3 and the roller wheel 7 are advantageously driven by the same drive 11 and via the same shaft 12. It is possible, as shown, to also drive the conveying belt 13, provided as onward transportation means 6, with the same drive 11, wherein the speed of the conveying belt is adjusted by means of a corresponding gear increase or reduction, e.g. identical to the tangential speed of the rotating grippers 5.

The device according to FIG. 1 comprises ten pairs of suction device/gripper 4/5 and ten rollers 9, such that a roller 9 is allocated to each suction-device/gripper-pair 4/5, wherein in the stack region the roller 9 allocated to a suction-device/gripper-pair 4/5 is moved upstream to the suction device 4 in-between the object gripped by the suction device 4 and the superposed, next object, and as long as the object is held by the suction device 4 of the gripper 5 remains positioned between these two objects. Naturally, it is possible to provide more or less than ten suction-device/gripper-pairs on the carrier wheel. It is also conceivable to allocate more than one roller 9 to each suction-device/gripper-pair 4/5, wherein these rollers then advantageously revolve as a compact group.

During their circulation, the suction devices 4 are rotated in actually known manner with the aid of corresponding controlling means in relation to a spoke 15, in which they are mounted. Before the 12 o'clock position they are, in relation to the rotation direction R deviated forward. Approximately in the 12 o'clock position (take-over region) they are rotated upwards for the gripping of the object 2 between successive rollers 9 into a approximately radial position and then deviated backwards in relation to the conveying direction for the bending of the gripped edge region towards the open upstream gripper 5. As long as the grippers 5 hold an object, the suction devices 4 remain in the backwards rotated position, but are, however, after the six o'clock position (disposal region) rotated into the forwards rotated position in order to again be ready for the take-over in the take-over position.

During their circulation, the grippers 5 are closed with the aid of a corresponding controlling means (not shown) directly after the 12 o'clock position (take-over region) and re-opened in the 6 o'clock position (disposal region).

The circulating path of the rollers 9 defined by the roller guide 10 is non-circular and in particular comprises a supporting region (12 o'clock position to approx. 2 o'clock position), in which the rollers 9 are conveyed beneath the stack simultaneously supporting it. In this supporting region the roller guide 10 is substantially rectilinear or at least has a relevantly larger bending radius than a circle concentric to the roller wheel 7. As the rollers 9 are to keep their positions between two successive objects 2, the supporting region cannot reach to the end of stacking space 1. For this reason it may be advantageous to apply a stationary supporting roller 16 to the rear side of the stacking space 1.

In the supporting region, the distances between the rollers 9 are relatively small, such that at the entrance of the supporting region sufficiently large extraction openings are on hand between them. Towards the exit of the supporting region, the distances between the rollers 9 are advantageously additionally decreased in order for the stack to be well supported. Thus, the rollers are delayed in relation to the suction-device/gripper-pairs 4/5 allocated to them and arrive in the upstream region of the objects separated from the stack.

The supporting region is followed by a conveying region (approx. 2 o'clock position to 6 o'clock position) in which the grippers 5 convey the objects 2 completely separated from the stack, wherein these are advantageously supported by a supporting means 17 (support 17.1 and supporting tape 17.2). The rollers 9 remain positioned between two objects in this region, i.e. upstream regions of objects are still positioned on the outer side of the revolving roll bed conveyor. Hereby the distance in-between the roller 9 and the axis A is advantageously reduced and the distance in-between successive rollers 9 is increased such that the rollers 9 in the disposal region (6 o'clock position) are positioned but little outside the distal ends of the spokes 15 and can possibly press the object released by gripper 5 in a medium or upstream region against the onward transportation means. The recirculation region follows (approx. 6 o'clock position to 12 o'clock position) in which the rollers 9 may again be guided radially towards the outside, such that the suction devices 4 may be rotated from their backwards rotated position into their forwards rotated position in an unobstructed manner.

It is not compulsory to the device according to the invention that the onwards transportation means 6 follows the gripper movement in the 6 o'clock position, neither is it compulsory that the onward transportation direction F is orientated in parallel to a tangent on the carrier wheel in the disposal region, as shown in FIG. 1. It is e.g. also possible to arrange the disposal region in the 3 o'clock position and orientate the onward transportation direction radially. Similarly, it is possible to pass on the objects held by the grippers 5 to a gripper conveyor for onward transportation instead of depositing them on a conveying belt. Advantageously the grippers of such a gripper conveyor, responsible for the onward transport, grip on the edge regions of the objects, which are opposite the edge regions gripped by the grippers of the carrier wheel.

FIG. 2 shows a further embodiment of the device according to the invention, which is similar to the embodiment according to FIG. 1 and in which the carrier wheel with the suction devices and grippers is not shown, through which the circulating movement of the rollers 9 and the levers 8 can be seen more clearly than in FIG. 1. From this Figure it can also be seen that, during their circulation controlled by the roller guide 10, the rollers 9 are held in locally defined positions by an additional controlling means. This, in the present case, consists of resilient means 18, by which the two flexibly mutually connected legs 8.1 and 8.2 of each lever 8 are prestressed against each other, such that the angle between the two legs is always the smallest possible.

As previously mentioned further above, it is also possible to prestress the legs 8.1 and 8.2 against each other, such that the named angle is always as large as possible. Alternative additional controlling means, which may be applied individually or in a combined manner, are a joint guide 20 (indicated with a broken line), in which e.g. the axis of the joints 8.3 or distal ends of the inner legs 8.1 circulate in a guided manner. Again as additional controlling means resilient means (not shown) may be applied, by which the angle between a tangent onto the roller wheel 7 and the inner leg 8.1 of the levers is always maintained as small as possible or as large as possible.

The levers 8 shown in FIGS. 1 and 2 comprise a joint 8.3 directed forwards in circulation direction. In other words, the inner legs 8.1 are pushed by the roller wheel 7 and the outer legs 8.2 are drawn by the inner legs 8.1. This is not a condition for the shown embodiment of the device according to the invention. The levers 8 may also be arranged with joints 8.3 directed rearwards.

The embodiment of the device according to the invention shown in FIG. 2, unlike the embodiment according to FIG. 1, comprises an onward transportation means 6, the conveying direction F of which is opposed to the tangential direction of movement of the grippers in the disposal region. In order for the deposit and the onward transportation to work faultlessly all the same, it is advantageous to install the position of the onward transportation means 6 and the position of the rollers 9 in the deposit region such that the roller 9 allocated to each object or suction-device/gripper-pair respectively presses the object 2 against the onward transportation means during the deposit, as previously mentioned in connection with FIG. 1 and is yet to be described in connection with FIG. 4.

Figure 3:
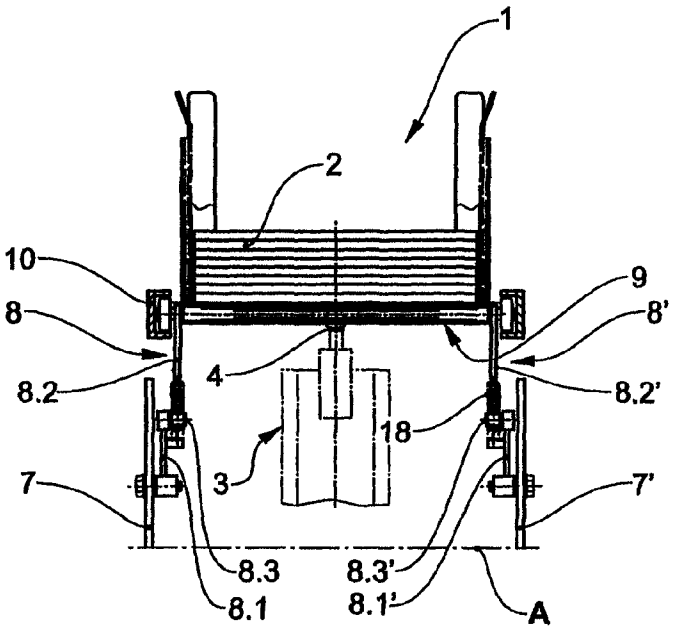
FIG. 3 shows the most important parts of the device according to FIG. 1 or 2 with angel of view in perpendicular to the axis of carrier wheel and roller wheel.

FIG. 3 shows the most important parts of the embodiment of the device according to the invention, as shown in FIGS. 1 and 2, with an angle of view in perpendicular to the axis A. Similar elements are denominated with the same reference numbers, wherein the elements previously described in detail in connection with FIGS. 1 and 2 are not mentioned here. FIG. 3, in particular, shows that the rollers 9 continuously extend in-between a left and a right lever 8 and 8' with corresponding inner legs 8.1 and 8.1', outer legs 8.2 and 8.2' and joints 8.3 and 8.3'. The two levers 8 and 8' are hereby each coupled to a left and a right roller wheel 7 and 7'. The two roller wheels are arranged on the left and on the right of the carrier wheel 3, advantageously at an identical axial distance to it. Naturally, it would also be possible to carry the rollers 9 on only one side on only one lever each.

The continuous rollers 9 shown in FIG. 3 become possible due to the circulating path of the rollers 9 comprising a dent in the recirculation region (between the 6 o'clock position and the 12 o'clock position), which dent allows a rotation of the suction devices 4 without conflict with rollers 9.

Figure 5:
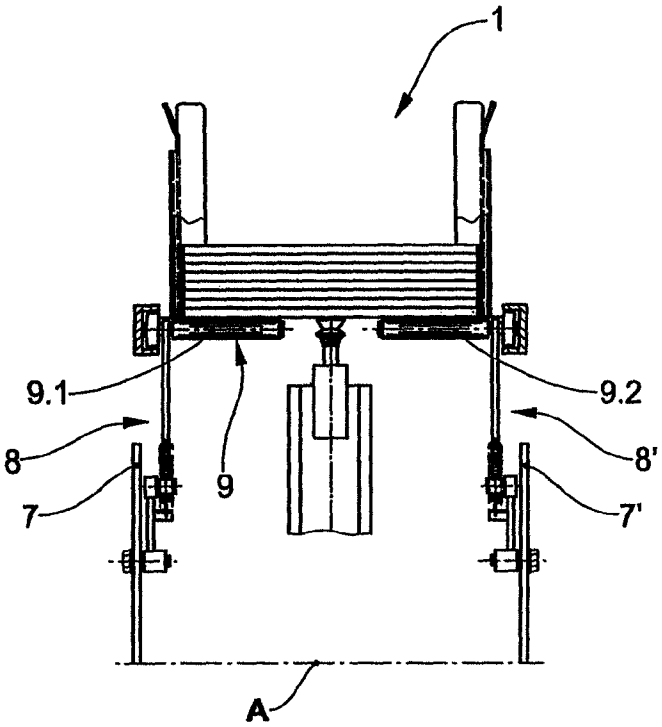
FIGS. 4 and 5 show a further exemplified embodiment of the device according to the invention with an angle of view in parallel to the axis of carrier wheel and roller wheel (FIG. 4) and in perpendicular to this axis (Fig.)
Figure 4:
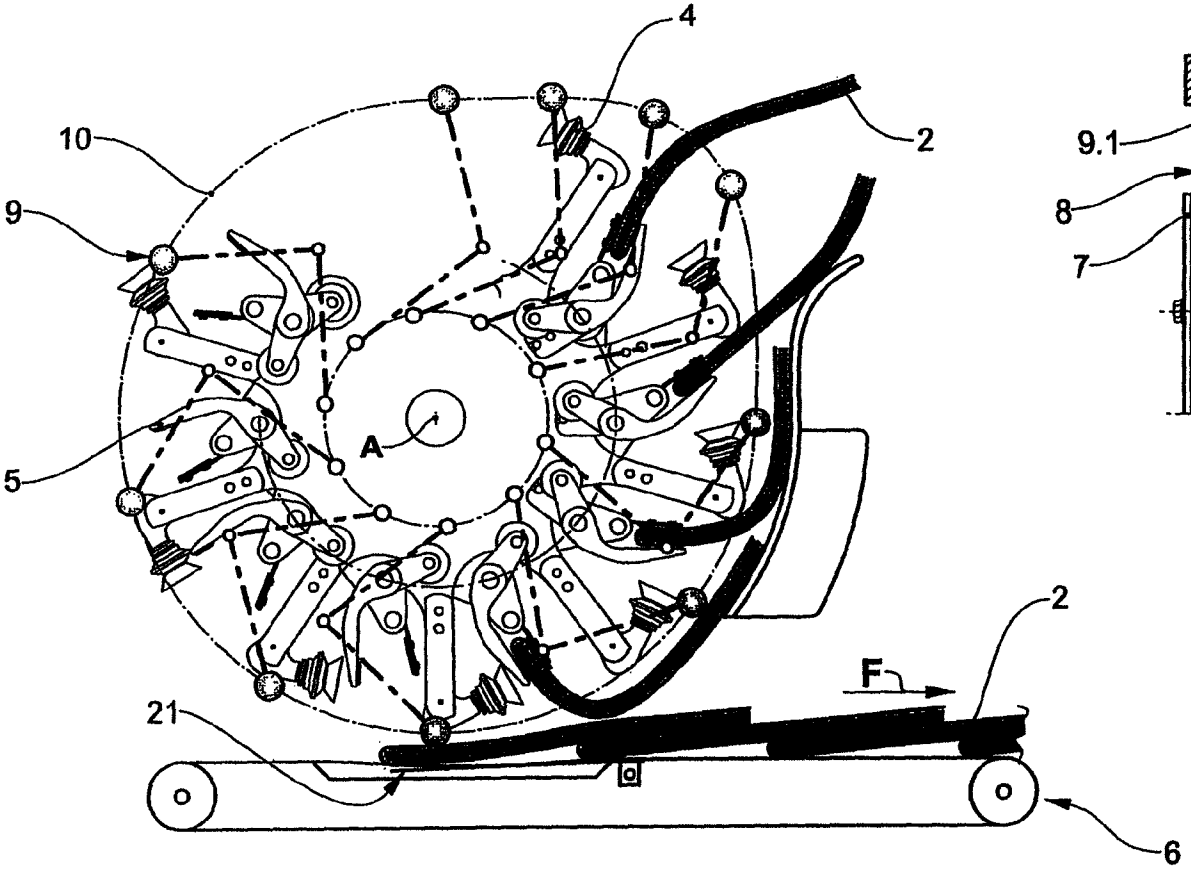

FIGS. 4 and 5 show a further exemplified embodiment of the device according to the invention. FIG. 4 shows the device without stacking space and with onward transportation means 6 with an angle of view in parallel to axis A and FIG. 5 with stacking space 1 and without onward transportation means with an angle of view in perpendicular to axis A. The embodiment according to FIGS. 4 and 5 differs from the embodiments shown in the preceding figures, in particular in that in the recirculation region of the rollers 9 (from approx. 6 o'clock position to 12 o'clock position) the roller guide 10 is not dented. This means that the suction device 4 would, when being rotated from the backward rotated position into the forward rotated position, come into conflict with rollers 6 of continuous kind, as shown in FIG. 3. For this reason the rollers 9, as can be seen from FIG. 5 are designed as two mutually aligned roller stubs 9.1 and 9.2, of which one is coupled over the left lever 8 to the left roller wheel 7 and the other is coupled over the right lever 8' to the right roller wheel 7'.

As can be seen from FIG. 4, in this embodiment again the onward transportation direction F of the tangential direction of movement of the grippers 5 in the disposing region is antipodal. For this reason the rollers 9 in this region (6 o'clock position) are controlled such that the roller 9 allocated to the disposing gripper 5 presses the object to be disposed and just disposed against the onward transportation means 6 in order for it to be carried away with this without problems and without dislocation. In order to enable the building up of a pressing force between the onward transportation means 6 and the roller 9 with the pressing function, the onward transportation means 6 is advantageously designed to be firmly resilient in this region, by means of e.g. mounting a support 21 made of spring steel underneath a conveying belt and by making the distance between onward transportation means 6 and roller guide 10 adaptable to the thickness of the objects 2 to be processed in the disposing region.

Figure 6:
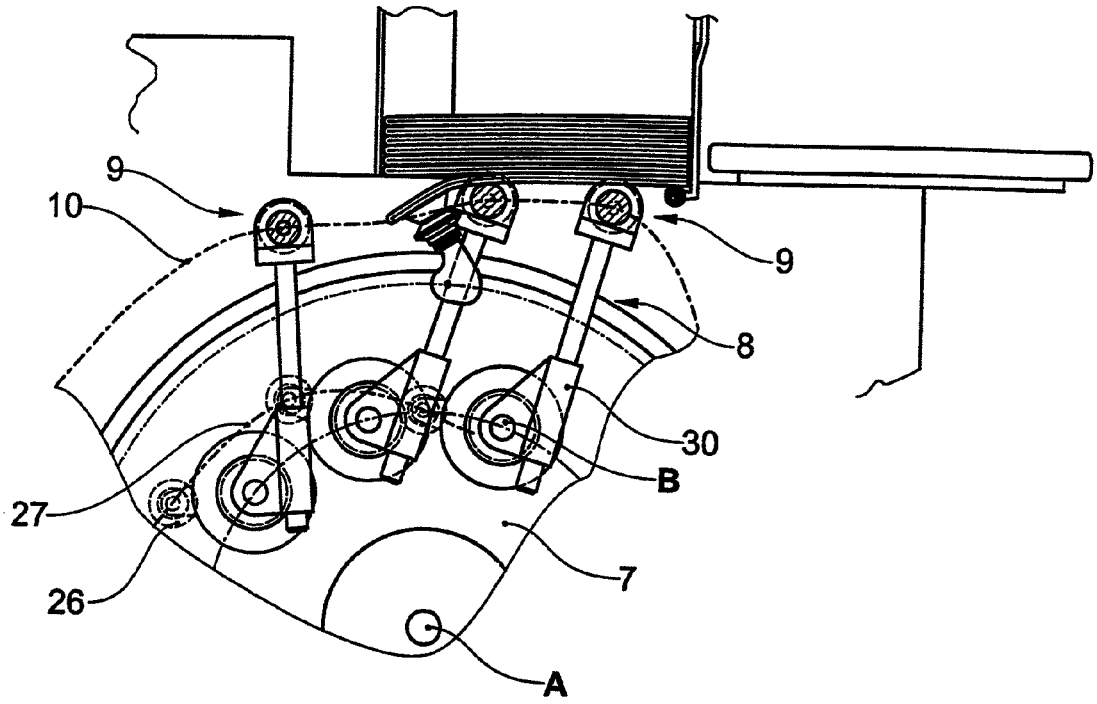
FIGS. 6 to 8 show a further exemplified embodiment of the device according to the invention, wherein the device is only partly shown, in parallel to the axis of the carrier wheel and the roller wheel (FIG. 6 and FIG. 7) and in perpendicular to this axis (FIG. 8).
Figure 7:
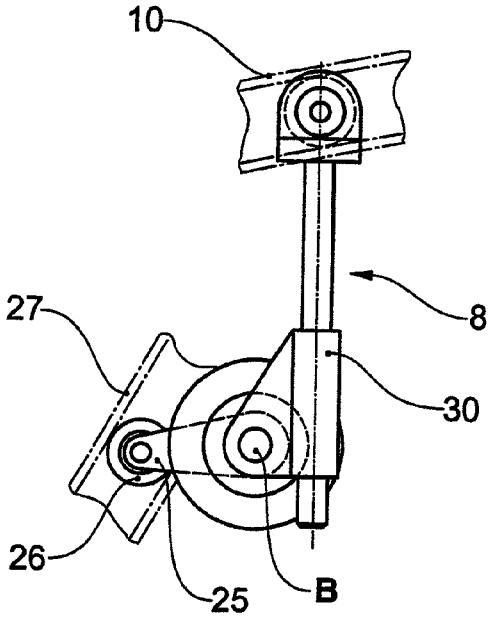
Figure 8:
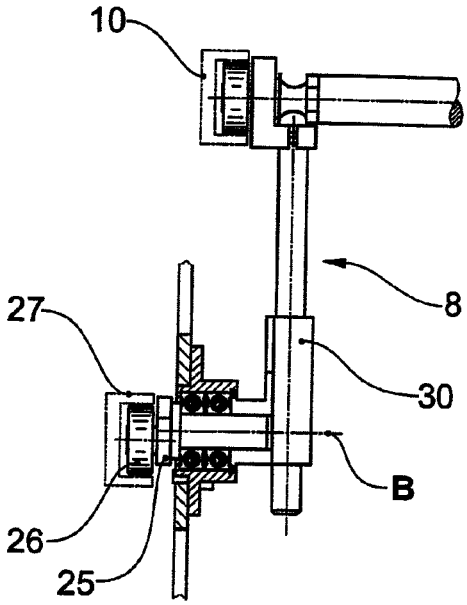

FIGS. 6 to 8 show a further exemplified embodiment of the device according to the invention. Only parts of the device are shown, in which this embodiment differs from the embodiments described further above. These are, in FIGS. 6 and 7, shown at an angle of view in parallel to the axis A of the carrier wheel (not shown) and roller wheel 7 and in FIG. 8 at an angle of view perpendicular to this axis.

In the embodiment of the device according to the invention according to FIGS. 6 to 8 the rollers, as in the embodiments described above, are flexibly coupled by means of levers 8 or possibly left and right levers to the roller wheel 7, such that the levers 8 are rotatable in parallel to the rotation plane of the roller wheel 7 in relation to it around axes B. The rollers are, as previously described, guided in a roller guide 10. Control levers 25 connected firmly to the levers 8 with control rollers 26, which are guided by cam 27, define the local rotation position of levers 8, i.e. they serve as additional controlling means.

The levers 8 are guided in lever guides 30 in a freely dislocatable manner, such that depending on the position of the roller guide 10 and the adjusted rotation position an actual length of lever (distance between axis A and roller 9) may be adjusted. Naturally it would also be possible to control the actual length of lever by means of an alternative additional controlling means (e.g. a cam, which defines the circulating path of the lever ends opposite the roller), instead of the rotation position of the lever 8, wherein a corresponding rotation position adjusts.

The devices in shown FIGS. 1 to 8 are examples of embodiments of the device according to the invention. The characteristics of these exemplified embodiments may obviously be combined differently, by means of which further exemplary embodiments of the device according to the invention are created.

The invention claimed is:

1. Device for separation of individual flat, bendable objects from the underside of a stack of such objects and for the onward transportation of such objects, comprising:

a stacking space with a supporting unit supporting the stack from beneath, wherein the supporting unit is a roll bed conveyor consisting of a plurality of circulating, freely rotatable rollers;

circulating suction devices and grippers for separation of objects from the underside of the stack, that are coupled to a carrier wheel arranged under the supporting unit with a substantially horizontal axis (A);

an onward transportation device; and a supporting region;

wherein the rollers are aligned with the suction devices and the grippers in the supporting region and are moved through the supporting region underneath the stack;

further comprising at least one roller wheel arranged coaxially to the carrier wheel and a roller guide defining a circulating path of the rollers;

wherein the rollers are coupled to the roller wheel by means of levers, wherein the levers are mounted rotatably to the roller wheel and rotate relative to the roller wheel parallel to a rotation plane of the roller wheel, and wherein the carrier wheel and the roller wheel are drivable to rotate at identical angular speeds.

2. Device according to claim 1, wherein the levers comprise an inner leg and an outer leg, wherein the legs are connected to one another in a joint such that they are pivotable in parallel to the rotation plane of the roller wheel.

3. Device according to claim 2, wherein a spring is arranged in-between the legs of the levers.

4. Device according to claim 3, wherein the legs of the levers are prestressed against each other, such that an angle between the two legs is kept minimal.

5. Device according to claim 2, further comprising a joint guide for guiding the joints, wherein the joint guide defines a circulating path of the joints.

6. Device according to claim 1, wherein the levers are freely displaceably guided in a lever guide.

7. Device according to claim 6, further comprising an additional controlling unit for controlling a pivot position or an effective length of the levers.

8. Device according to claim 7, wherein the additional controlling unit comprises control levers firmly connected to the levers, control rollers and cams arranged on the control levers, wherein the control rollers roll on the cams.

9. Device according to claim 1, wherein the roller guide, which is arranged below the stacking space, is substantially rectilinear and approximates the axis in a conveying region following the supporting region in rotation direction.

10. Device according to claim 1, wherein on the left side and on the right side of the carrier wheel in each case a roller wheel is provided.

11. Device according to claim 10, wherein the roller guide comprises a dent in a recirculation region and that the rollers are coupled on both sides by means of a respective lever to a respective roller wheel.

12. Device according to claim 10, wherein each roller comprises a left and a right roller part, wherein one roller part is coupled via a lever to one of the roller wheels and the other roller part is coupled via a different lever to the other roller wheel.

13. Device according to claim 1, wherein the onward transportation device is a conveying belt or a gripper conveyor.

14. Device according to claim 1, wherein the onward transportation device is arranged such that its conveying direction aligns tangentially to the circular movement of the grippers and has the same direction.

15. Device according claim 1, wherein a conveying direction of the onward transportation device is orientated opposite to the circular movement of the grippers.

16. A method of separating flat, bendable objects from the underside of a stack of such objects and the onward transportation of such objects comprising the steps of:

providing a stacking space including a stack of bendable flat bendable objects;

supporting the stack from beneath using a roll bed conveyor consisting of a plurality of circulating, freely rotatable rollers;

coupling the rollers to a roller wheel by means of levers, wherein the levers are mounted rotatably to the roller wheel and rotate relative to the roller wheel parallel to a rotation plane of the roller wheel;

driving the roller wheel and a carrier wheel at identical angular speeds;

separating objects from the underside of the stack using circulating suction devices and grippers that are coupled to the carrier wheel arranged under the supporting unit, wherein the rollers are aligned with the suction device and the grippers in the supporting region;

placing the separated objects onto an onward transportation device.

* * * * *